US007530140B2

(12) United States Patent
Makarov et al.

(10) Patent No.: US 7,530,140 B2
(45) Date of Patent: May 12, 2009

(54) VACUUM CLEANER WITH ULTRAVIOLET LIGHT SOURCE AND OZONE

(75) Inventors: Sergey V. Makarov, Solon, OH (US); Gregg M. Kloeppel, Sheffield Lake, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 659 days.

(21) Appl. No.: 11/234,534

(22) Filed: Sep. 23, 2005

(65) Prior Publication Data

US 2007/0067943 A1 Mar. 29, 2007

(51) Int. Cl.
*A47L 9/16* (2006.01)

(52) U.S. Cl. ..... 15/339; 15/347; 15/350; 15/353; 15/DIG. 8; 55/485; 55/329; 55/DIG. 3

(58) Field of Classification Search ..... 15/339, 15/347–353, DIG. 8; 55/485, 486, 429, DIG. 3; *A47L 9/16, 9/28*

See application file for complete search history.

(56) References Cited

U.S. PATENT DOCUMENTS

| | | | | |
|---|---|---|---|---|
| 2,242,163 | A | 5/1941 | Bargeboer | |
| 2,590,152 | A | 3/1952 | Buckey | |
| 2,648,396 | A | 8/1953 | Kirby | |
| 4,485,519 | A | 12/1984 | Collier | |
| 5,185,903 | A | 2/1993 | Choi | |
| 5,230,722 | A | 7/1993 | Yonkers | |
| 5,493,754 | A | 2/1996 | Gurstein et al. | |
| 6,053,968 | A | 4/2000 | Miller | |
| 6,434,785 | B1 | 8/2002 | Vandenbelt et al. | |
| 6,589,323 | B1 * | 7/2003 | Korin | 96/223 |
| 6,776,824 | B2 | 8/2004 | Wen | |
| 6,869,468 | B2 | 3/2005 | Gibson | |
| 6,968,595 | B2 | 11/2005 | Oh et al. | |
| 2003/0192816 | A1 | 10/2003 | Opfel | |
| 2004/0211444 | A1 * | 10/2004 | Taylor et al. | 134/18 |
| 2005/0091785 | A1 * | 5/2005 | Yuen | 15/350 |

FOREIGN PATENT DOCUMENTS

JP 2003325404 * 11/2003

* cited by examiner

*Primary Examiner*—David A Redding
(74) *Attorney, Agent, or Firm*—Fay Sharpe LLP

(57) ABSTRACT

The present disclosure provides a vacuum cleaner including a nozzle base having a main suction opening and a housing pivotally mounted on the nozzle base. An airstream suction source is mounted to one of the housing and the nozzle base for selectively establishing and maintaining a suction airstream flowing from the nozzle main suction opening to an exhaust outlet of the suction source. A filter housing is mounted to one of the nozzle base and the housing. The filter housing comprises a filter mounted in the filter housing. An ultraviolet light source is disposed in the filter housing and shines on the filter for disinfecting same.

24 Claims, 12 Drawing Sheets

VACUUM CLEANER WITH ULTRAVIOLET LIGHT SOURCE AND OZONE

CROSS REFERENCE TO RELATED PATENTS AND APPLICATIONS

This application is related to U.S. patent application Ser. No. 11/082,501 entitled "TWIN CYCLONE VACUUM CLEANER", commonly owned and expressly incorporated herein by reference.

BACKGROUND OF THE INVENTION

The present invention relates to vacuum cleaners. More particularly, the present invention relates to vacuum cleaners which condition the exhaust air they emit.

Both canister and upright vacuum cleaners are well known in the art. Generally, a filter bag is used to filter the dirt and hold the dirt so as to exhaust relatively clean air back into the environment. After multiple uses of the vacuum cleaner, the filter bag must be replaced.

To avoid the need for vacuum filter bags, and the associated expense and inconvenience of replacing the filter bag, a newer type of vacuum cleaner utilizes cyclonic airflow, a dust cup and one or more filters, rather than a replaceable filter bag, to separate the dirt and other particulates from the suction air stream. Such filters need infrequent replacement.

Bagless vacuum cleaners typically collect the separated dirt in a dust cup or dirt-collecting receptacle while discharging the cleaned air through a grill assembly. However, the cleaned air being discharged may still contain noxious materials and odor, thereby causing them to exhaust along with the cleaned air into the room. In addition, the dirt-collecting receptacle provides a suitable place for various bacteria and viruses to live and breed. Such bacteria and viruses can be released to the room when the dirt collected in the dirt collecting receptacle is empted, thereby further polluting the room.

In order to solve the above described problems, it would be desirable to provide a vacuum cleaner with a means for reducing, if not eliminating, bacteria, viruses and the like. One such means is an ultraviolet (UV) light source which emits radiation powerful enough to destroy bacteria and viruses. Another such means is ozone, which can be created from ambient oxygen by, for example, the UV light source.

Ozone is a gas whose molecules are composed of three bonded oxygen atoms. Ozone is a highly reactive substance, which is used to treat drinking water and swimming pool water, treat industrial waste, and to bleach inorganic products such as clay. Ozone is the second most powerful oxidant after fluorine. It is also a powerful disinfectant which can destroy airborne bacterial and viral contaminants, and which can oxidize chemical contaminants.

It would be desirable to improve conventional vacuum cleaner designs by providing a means for eradicating bacteria, viruses and fungi in the airflow of a vacuum cleaner. It would also be desirable to simplify assembly, improve filtering and improve the disinfection of the dirt held in a dirt-collecting receptacle while maintaining the environment outside of the vacuum cleaner clean of bacteria, noxious materials and odor.

Accordingly, the present invention provides a new and improved vacuum cleaner including a UV light source which overcomes difficulties with the prior art while providing better and more advantageous overall results.

BRIEF DESCRIPTION OF THE INVENTION

In one embodiment of the present invention, a filter housing assembly for a vacuum cleaner is provided.

More particularly, in accordance with one aspect of the present invention, the filter housing assembly includes a suction airstream inlet and a suction airstream outlet. The assembly comprises a housing member mounted to the vacuum cleaner. A first filter is mounted in the housing member and an ultraviolet light source is located in the housing member for disinfecting an interior of the filter housing. An electrical socket provides a power source to the ultraviolet light source.

In accordance with another aspect of the present invention, a vacuum cleaner includes a nozzle base having a main suction opening and a housing pivotally mounted on the nozzle base. An airstream suction source is mounted to one of the housing and the nozzle base for selectively establishing and maintaining a suction airstream flowing from the nozzle main suction opening to an exhaust outlet of the suction source. A filter housing assembly is mounted to one of the nozzle base and the housing. The filter housing assembly comprises a filter mounted in the filter housing assembly. An ultraviolet light source is disposed in the filter housing assembly and shines on the filter for disinfecting same.

In accordance with still another aspect of the present invention, a vacuum cleaner includes a housing in fluid communication with a main suction opening. An airstream suction source is mounted to the housing for selectively establishing and maintaining a suction airstream flowing from the main suction opening to an exhaust outlet of the suction source. A filter housing assembly is mounted to the housing comprises a first filter and a second filter. An ultraviolet light source is disposed between the first and second filters, the ultraviolet light source shining on the first and second filters for disinfecting same.

In accordance with still yet another aspect of the present invention, a vacuum cleaner comprises a dirt cup and first and second cyclonic airflow chambers located in the dirt cup. The second cyclonic flow chamber is positioned adjacent to and parallel to the first cyclonic flow chamber, wherein the first and second chambers are oriented generally vertically. A filter housing assembly is disposed downstream from the first and second cyclonic flow chambers and accommodates at least one filter for filtering dirt from the airstream. An ultraviolet light source is secured to at least one of the dirt cup and the filter housing assembly.

Still other aspects of the invention will become apparent from a reading and understanding of the detailed description of the several embodiments hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the invention.

DETAILED DESCRIPTION OF THE PREFERRED EMBODIMENTS

It should, of course, be understood that the description and drawings herein are merely illustrative and that various modifications and changes can be made in the structures disclosed without departing from the scope and spirit of the invention. Like numerals refer to like parts throughout the several views.

While the present disclosure of a means for cleaning an airstream is illustrated as being suitably secured to an upright vacuum cleaner having a cyclonic air flow design, it should be appreciated that the invention can be adapted for a wide variety of other vacuum cleaners as well, such as canister type, non-cyclone and bagged-type vacuum cleaners.

Figure 1:
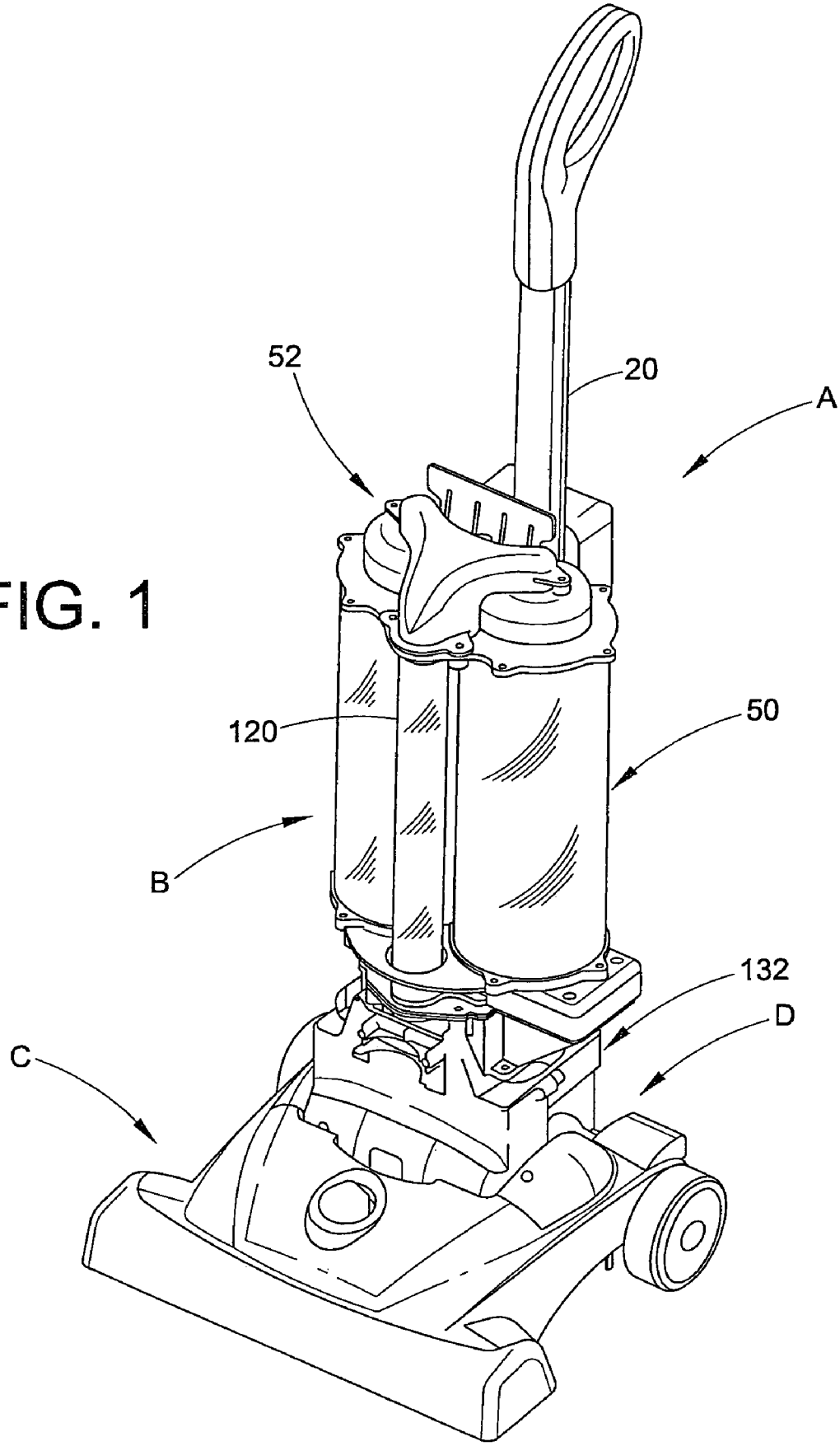
FIG. 1 is a front perspective view illustrating a cyclonic air flow vacuum cleaner including a dirt cup and a filter housing assembly in accordance with a first embodiment of the present invention.

Referring now to the drawings, wherein the drawings illustrate several embodiments of the present invention only and are not intended to limit same, FIG. 1 shows an upright vacuum cleaner A including an upright housing section B and a nozzle base section C. The sections B and C are pivotally or hingedly connected through the use of trunnions or another suitable hinge assembly D so that the upright housing section B pivots between a generally vertical storage position (as shown) and an inclined use position. Both the upright and nozzle sections B and C can be made from conventional materials, such as molded plastics and the like. The upright section B includes a handle 20 extending upward therefrom, by which an operator of the vacuum cleaner A is able to grasp and maneuver the vacuum cleaner.

Figure 2:
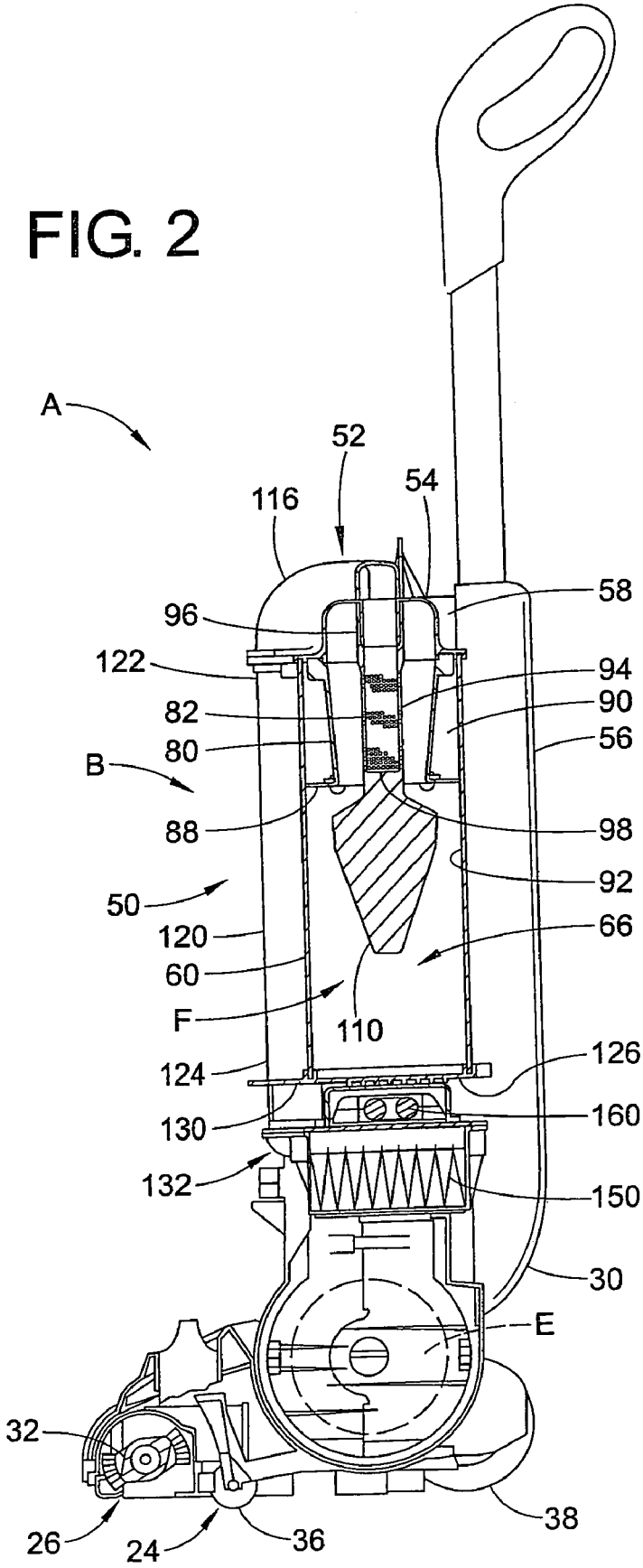
FIG. 2 is a right side elevational view in cross section, and partially broken away, of the cyclonic air flow vacuum cleaner of FIG. 1.
Figure 3:
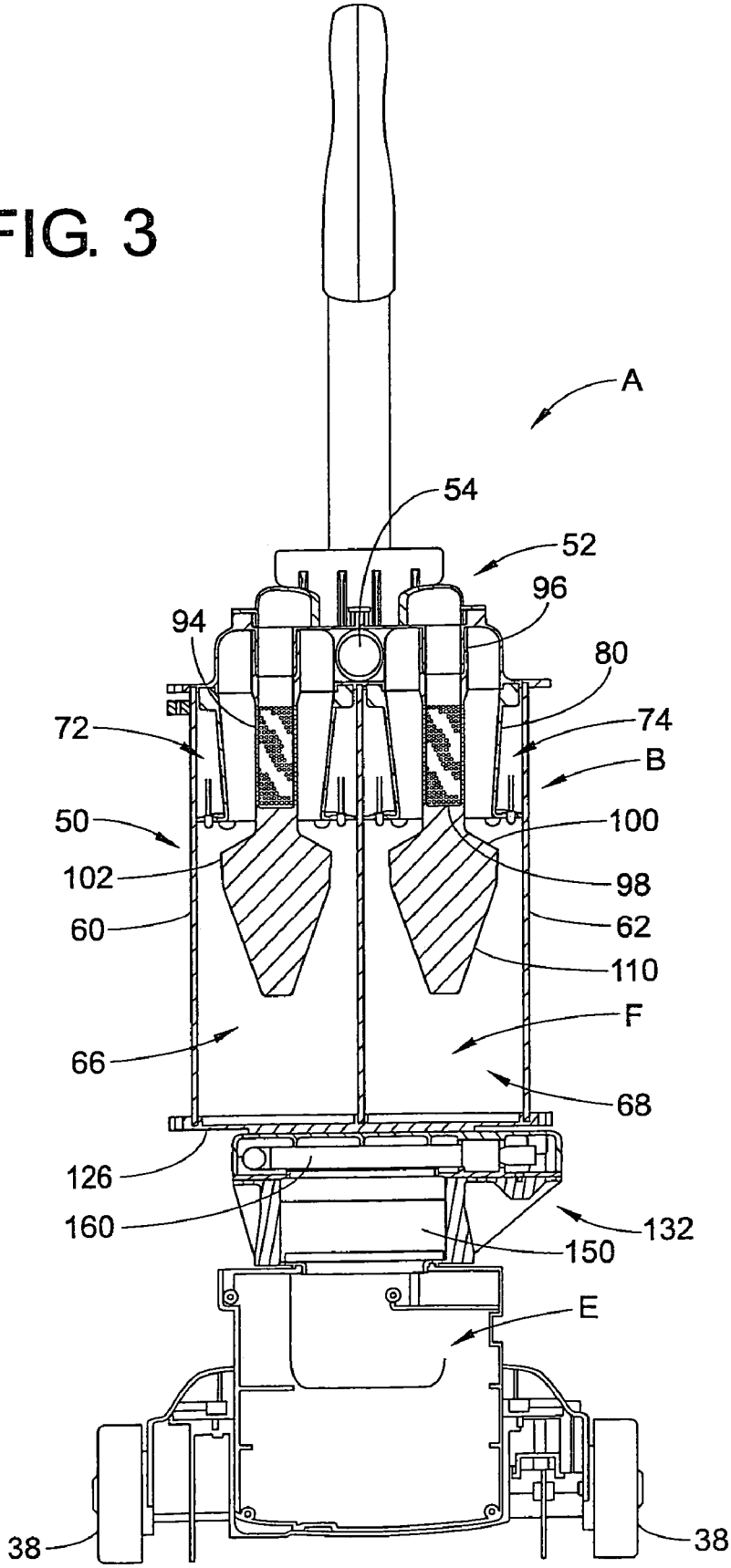
FIG. 3 is a rear elevational view in cross section, and partially broken away, of the cyclonic air flow vacuum cleaner of FIG. 1.

During vacuuming operations, the nozzle base C travels across a floor, carpet, or other subjacent surface being cleaned. With reference now to FIGS. 2 and 3, an underside 24 of the nozzle base includes a main suction opening 26 formed therein, which can extend substantially across the width of the nozzle at the front end thereof. As is known, the main suction opening 26 is in fluid communication with the vacuum upright body section B through a passage and a connector hose assembly, such as at 30. A rotating brush assembly 32 is positioned in the region of the nozzle main suction opening 26 for contacting and scrubbing the surface being vacuumed to loosen embedded dirt and dust. A plurality of wheels 36 and 38 supports the nozzle on the surface being cleaned and facilitate its movement thereacross.

The upright vacuum cleaner A includes a vacuum or suction source for generating the required suction airflow for cleaning operations. A suitable suction source, such as an electric motor and fan assembly E, generates a suction force in a suction inlet and an exhaust force in an exhaust outlet. The motor assembly airflow exhaust outlet is in fluid communication with an exhaust grill (not visible). If desired, a final filter assembly can be provided for filtering the exhaust airstream of any contaminants which may have been picked up in the motor assembly immediately prior to its discharge into the atmosphere. As shown in FIGS. 2 and 3, the motor assembly suction inlet, on the other hand, is in fluid communication with a dust and dirt separating region F of the vacuum cleaner A to generate a suction force therein.

The dust and dirt separating region F housed in the upright section B includes a dirt cup or container 50 which is releasably connected to the upper housing B of the vacuum cleaner. Cyclonic action in the dust and dirt separating region F removes a substantial portion of the entrained dust and dirt from the suction airstream and causes the dust and dirt to be deposited in the dirt container 50. The suction airstream enters an air manifold 52 of the dirt container through a suction airstream inlet section 54 which is formed in the air manifold. The suction airstream inlet 54 is in fluid communication with a suction airstream hose or conduit 56 through a fitting 58 as illustrated in FIG. 2. The dirt container 50 can be mounted to the vacuum cleaner upright section B via conventional means.

In many respects, the dirt container 50 and the air manifold 52 are like the dirt containers and air manifolds shown and described in commonly owned U.S. patent application Ser. No. 11/082,501, expressly incorporated herein by reference. To the extent possible, other features discussed in reference to one or more of the embodiments of the above-referenced '501 application can also be optionally included on the dirt container 50 and the air manifold 52.

As shown in FIG. 3, the dirt container 50 includes first and second generally cylindrical sections 60 and 62. Each cylindrical sections includes a longitudinal axis, the longitudinal axis of the first cylindrical section is spaced from the longitudinal axis of the second cylindrical section. The first and second cylindrical sections define a first cyclonic airflow chamber 66 and a second cyclonic airflow chamber 68, respectively. The first and second airflow chambers are each approximately vertically oriented and are arranged in a generally parallel relationship.

The first and second cyclonic airflow chambers include respective first and second cyclone assemblies 72 and 74. The first and second cyclone assemblies act simultaneously to remove coarse dust from the respective airstream flowing therethrough. Each cyclone assembly includes a separator cone 80 and a perforated tube 82 disposed within the separator cone. The separator cones have a larger diameter end located adjacent a top portion of the dirt container 50 and a smaller diameter end spaced from the top portion. A flange 88 extends radially from the smaller diameter end. As best illustrated in FIG. 2, the flange is dimensioned to effectively seal off a space 90, which is defined by an inner surface 92 of each cylindrical section 60, 62 and an outer periphery of the separator cone 80, from the dirt entrained airstream entering into the first and second cyclonic airflow chambers 66, 68.

Each perforated tube 82 extends longitudinally in its respective cyclonic airflow chamber 66 and 68. Each perforated tube 82 includes a plurality of small holes 94 disposed in a side wall of the tube for removing threads and fibers from the airstream. The diameter of the holes 94 and the number of those holes within the perforated tube 82 directly affect the filtration process occurring within each cyclonic airflow chambers 66, 68. Also, additional holes result in a larger total opening area and thus the airflow rate through each hole is reduced. Thus, there is a smaller pressure drop and lighter dust and dirt particles will not be as likely to block the holes.

Each perforated tube further includes an upper end 96 in fluid communication with the inlet section 54 of the air manifold 52 and a closed lower end 98. The closed lower end of each tube 82 includes an outwardly flared section 100 for retarding an upward flow of dust that has fallen below the lower end 98. A flange or skirt 102 extends longitudinally from the flared section 100 which also blocks rising dust from reentering the separator cone, thereby further improving the filtering of the dust entrained airstream.

With continued reference to FIGS. 2 and 3, extending from the closed lower end 98 of each tube 80 is a laminar flow member 110. Each laminar flow member generally includes at least one pair of blades (not visible) which can have various conformations, such as a cross shape, a rectangular shape, a triangular shape and an elliptical shape when viewed from its side. In addition, the blades can be oriented at angles other than normal to each other.

As illustrated in FIGS. 2 and 3, the air manifold 52 is disposed at a top portion of the dirt container 50. The air manifold directs dirty air to each of the first and second cyclonic flow chambers 66, 68 and directs a flow of cleaned air from each of the first and second cyclonic flow chambers to the electric motor and fan assembly of the vacuum cleaner A. The air manifold 52 includes the inlet section 54 through which dirty air passes and an outlet section 116. The inlet section, which is in fluid communication with the nozzle main suction opening, directs a flow of the dirty airstream into the first and second airflow chambers 66, 68. The airflow into the airflow chambers is tangential which causes a vortex-type, cyclonic or swirling flow. Such vortex flow is directed downwardly in the airflow chamber since the top end thereof is blocked by the flange 88 of the separator cone 80.

As the dirt entrained air enters the airflow chambers 66, 68, the air and the dirt cyclonically rotate along an inner wall of the separator cone 80. The dirt and debris is removed from the air flow and collects at a bottom portion of the chambers. However, relatively light fine dust is less subject to a centrifugal force. Accordingly, the fine dust may be contained in the airflow circulating near the bottom portion of the airflow chambers 66, 68. Since the laminar flow member 110 extends into the bottom portion of the airflow chambers, the circulating airflow hits the blade of the laminar flow member, thereby forming a laminar flow. Thus, the cyclonic flow of the airstream is stopped by the laminar flow member 110. The fine dust in the airflow drops out of the airstream and falls by gravity in each of the airflow chambers 66, 68. The fine dust is collected at a bottom portion of the chambers.

The cleaned and now laminar axial flow of air then makes a 900 turn and becomes a radial flow, as mandated by the presence of the skirt 102. This change in air flow direction will cause even more dirt to fall out of the airflow. Then, the air flows again axially up the flange until it is again allowed to flow radially inwardly once it clears the outwardly flared section 100 at the lower end of each tube. The cleaned air is then discharged out through the holes 94 of the perforated tube 82 and the outlet section 116. The outlet section collects a flow of cleaned air from both of the airflow chambers and merges the flow of cleaned air into the single cleaned air outlet passage 120.

With continued reference to FIG. 2, the outlet passage 120 has a longitudinal axis which is oriented approximately parallel to the longitudinal axes of the first and second cyclonic chambers 66, 68. An inlet end 122 of the outlet passage 120 is secured to a lower portion of the air manifold 52. An outlet end 124 of the outlet passage 120 extends through an opening located in a bottom wall 126 of the dirt container 50 and a corresponding suction airstream inlet 130 (FIG. 4) located in a filter housing assembly 132.

As shown in FIGS. 2 and 3, the filter housing assembly 132, which in the present embodiment is located downstream of the dirt container 50, includes a housing member 134 suitably secured to one of the upright housing section B and a nozzle base section C by conventional means.

Figure 4:
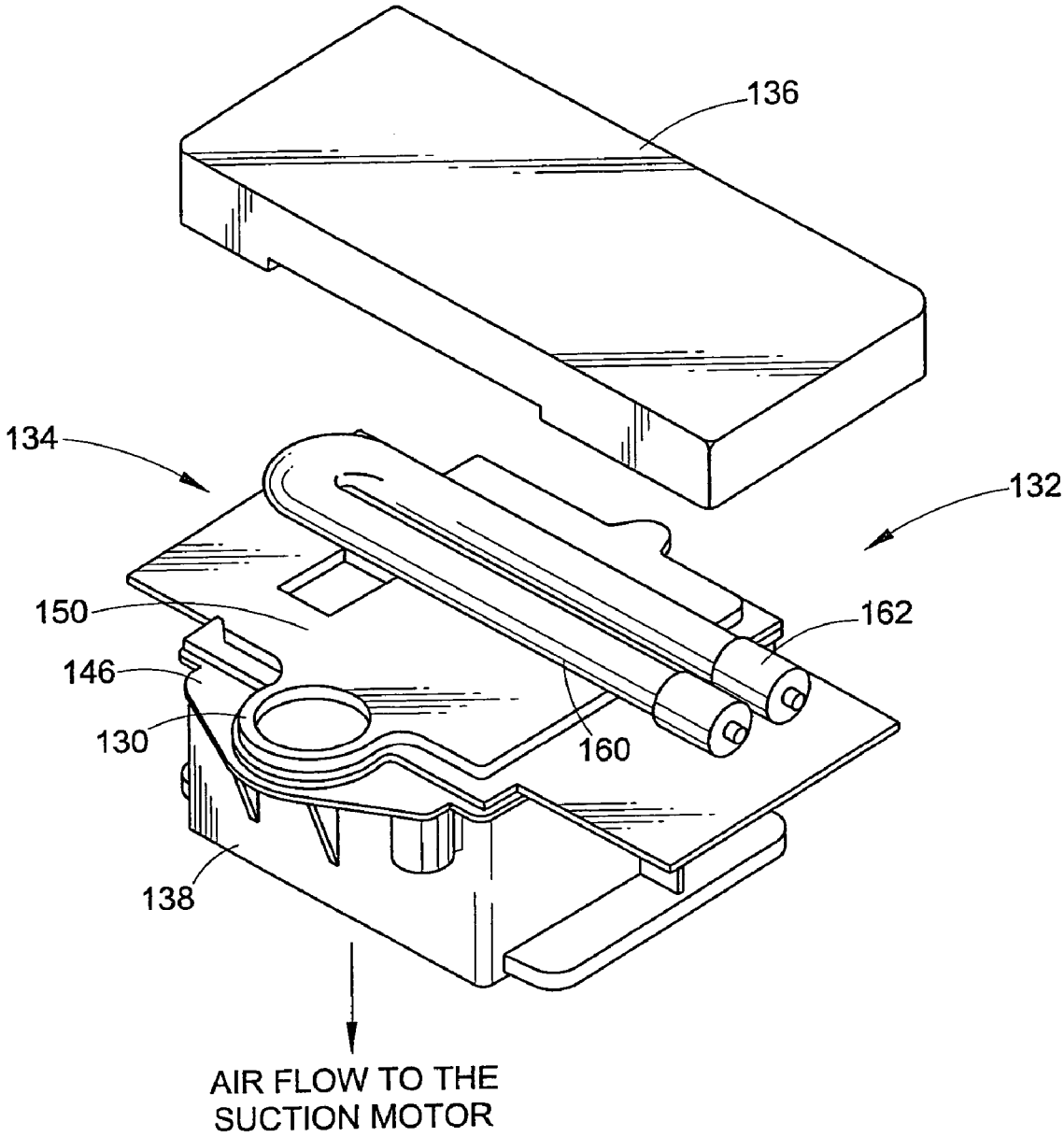
FIG. 4 is a partially exploded front perspective view of the filter housing assembly of FIG. 2.

With reference now to FIG. 4, the housing member 134 comprises a cover 136 releasably secured to a base 138 by conventional fasteners. The cover can include mounting means for mounting the dirt container to the filter housing assembly 132. The base has an outwardly extending flange 146 which includes a portion of the suction airstream inlet 130 which is in fluid communication with the nozzle main suction opening 26.

The suction airstream inlet 130 directs the airstream flowing from the outlet end 124 of the outlet passage 120 to a filter 150 housed in the filter housing assembly 132. The filter 150 is in fluid communication with the outlet end 124 of the outlet passage 120 and retains any dust escaping from the dirt container. The filter 150 can comprise a pleated filter material and can be an electrostatic or High-Efficiency Particulate Arresting (HEPA) grade filter, which is capable of trapping very small dust particles. The filter is in fluid communication with a suction airstream outlet (not visible) located on a bottom surface of the base 138. The outlet is in fluid communication with the inlet of the electric motor and fan assembly E.

The filter housing assembly 132 further includes an ultraviolet light (UV) source 160 for disinfecting the airstream inside the filter housing. In the present embodiment, the UV light source generates a magnetic or electric field capable of emitting radiation powerful enough to destroy bacteria and viruses.

UV light represents the frequency of light between 200 nanometers (nm) and 400 nm and cannot be seen with the naked eye. Within the UV spectrum lie three distinct bands of light: UV-A, UV-B and UV-C. Longwave UV light (approximately 315 nm to approximately 400 nm), or UV-A, refers to what is commonly called black light. UV-B (approximately 280 nm to approximately 315 nm), or midrange UV, generally causes sunburn. Germicidal UV light (approximately 200 nm to approximately 280 nm), or UV-C, is effective in microbial control. In the present embodiment, the UV light source 160 can be a germicidal UV-C light source that preferably emits radiation having wavelength of approximately 254 nm. This wavelength has been proven effective in diminishing or destroying bacteria, common germs, yeasts, mold and viruses to which the UV light source is exposed. However, the germicidal UV light source 160 is not limited to UV light sources having wavelength of 254 nm. It should be appreciated that other UV light sources with germicidal properties could also be used.

The UV light source can be mounted in the housing member 134 by conventional means and is preferably disposed above the filter 150 so that the UV light source can shine on the filter. It has been proven that the residence time of bacteria, fungi and/or viruses trapped in or on the filter is great enough that exposure to the UV light source will either destroy the micro-organism or neutralize its ability to reproduce. It will be appreciated that the UV light source 160 can remain on after the electric motor and fan assembly E or the vacuum cleaner is turned off. This will extend the exposure time for the micro-organisms that were deposited onto the filter 150 to the UV light source. After a set time, the UV light source will then be automatically turned off. To ensure that the UV light source 160 works effectively, the cover 136 can be removed from the base 138 so that regular maintenance checks can be performed to remove any dust build up on the UV light source.

An electrical socket 162 is mounted on an end of the UV light source 160 for providing a power source from the vacuum cleaner to the UV light source. To this end, the cover 136 can include an opening for an electrical connector which provides the power source to the electrical socket 162. For example, the power source can be the same power source that powers the electric motor and fan assembly E. Typically, the UV light source 160 has a low current and draws under twenty-four watts. However, based on the close proximity of the UV light source to the filter 150, the intensity of the UV light source can be equivalent to a sixty watt light bulb.

It should be appreciated that portions of the vacuum cleaner irradiated by the germicidal UV light source, such as the dirt container and the filter housing assembly, can be made of a UV resistant material. One suitable such material can be UV resistant plastic material, such as NORYL®, which is manufactured by General Electric Plastics Global Products, and is certified for use with ultraviolet light.

In addition to disinfecting the airstream inside the filter housing 202, the UV light source 160 can create ozone ($O^3$) from ambient oxygen ($O^2$). Ultraviolet wavelengths shorter than 200 nm (typically 185 nm) are capable of producing ozone from oxygen in the air. Ozone is a gas whose molecules are composed of three bonded oxygen atoms. It is also a powerful disinfectant which can destroy any remaining airborne bacterial and viral contaminants. The ozone can also oxidize chemical contaminants. One of ozone's advantages is that it can be carried by air into places that the UV radiation cannot reach directly. To avoid release of ozone into the environment, the airstream can be filtered through carbon or other adsorbent medium in the housing member 134 or passed through a metallic mesh or grid, such as zinc (to form zinc oxide), covering the suction airstream outlet located on the bottom surface of the base 138. Importantly, the by-products of ozone degradation have biological contaminant destroying ability, as well. Alternatively, the ozone laden airstream can be passed through a final filter assembly having an adsorbent medium immediately prior to its discharge into the atmosphere.

It should be appreciated that the amount of ozone emitted can be controlled by filtering the UV light source 160 thus keeping the level of ozone below the regulated environmental limits. A closed loop control system (not shown) can be implemented to monitor the amount of ozone in ambient air and can turn off the UV light source 160 if the amount of ozone is close the regulated environmental limits. As the level of ozone decreases, the closed loop control system can turn back on the UV light source 160. It should also be appreciated that the filter housing assembly 132 can include a separate conventional ozonizer for producing ozone in the housing member 134.

Similar to the aforementioned embodiment, a second embodiment of the present invention is shown in FIGS. 5-9.

Figure 5:
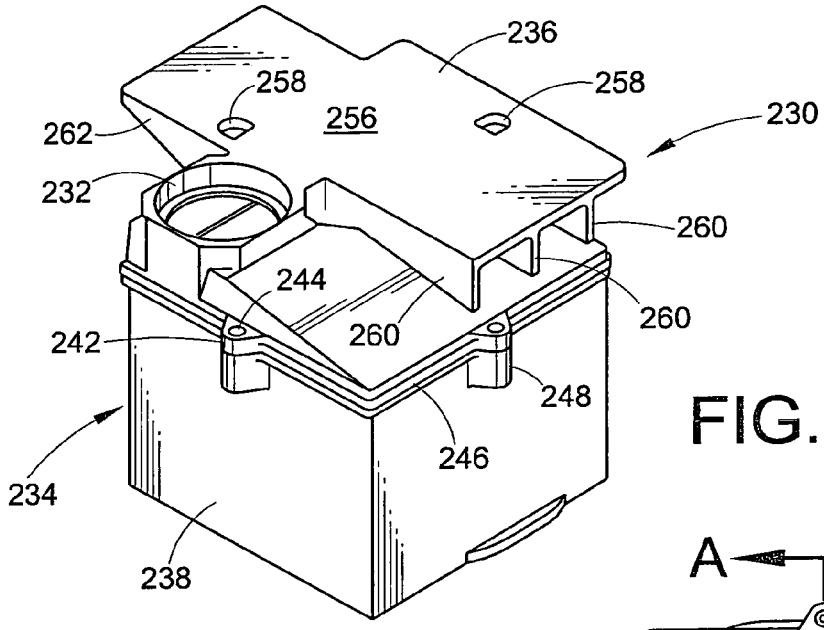
FIG. 5 is a front perspective view of a filter housing assembly for a vacuum cleaner in accordance with a second embodiment of the present invention.
Figure 6:
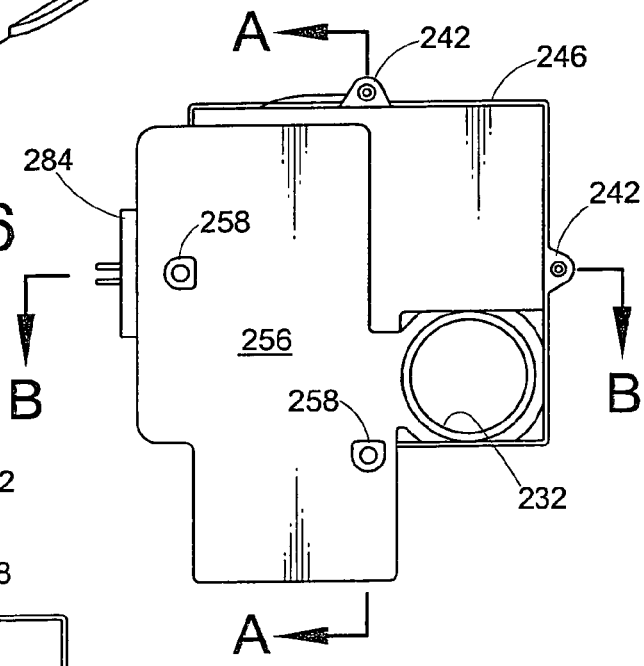
FIG. 6 is a top plan view of the filter housing assembly of FIG. 5.
Figure 7:
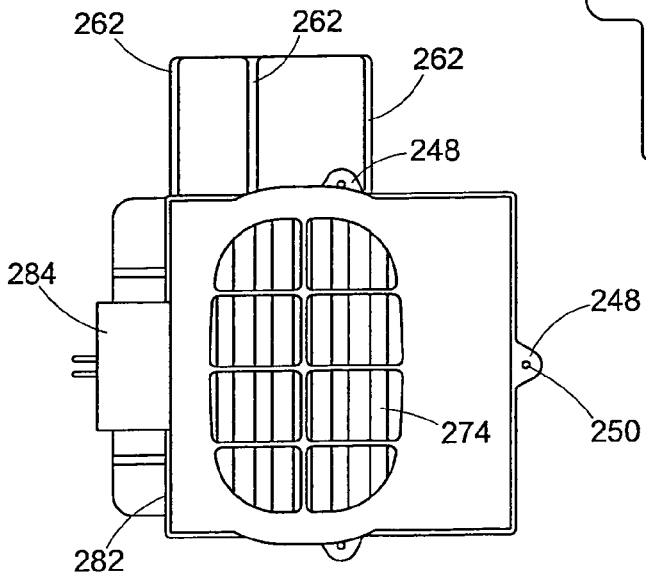
FIG. 7 is a bottom plan view of the filter housing assembly of FIG. 5.

With reference now to FIGS. 5-7, a filter housing assembly 230 for a vacuum cleaner which can be a canister or an upright vacuum cleaner is there shown. The housing assembly can be located downstream of a dirt container and includes a suction airstream inlet 232 and a housing member 234. The suction airstream inlet 232 is in fluid communication with a nozzle main suction opening. The housing member 234 is suitably secured to a housing (not shown) of the vacuum cleaner.

The housing member 234 comprises a cover 236 releasably secured to a base 238. To secure the cover to the base, the cover includes at least one tab 242 having an opening 244, the tab extending outwardly from an edge 246 of the cover. The base 238 includes at least one corresponding protrusion 248 having a opening 250. In this embodiment, three such tabs 242 and protrusions 248 are provided. The cover is positioned on the base such that the openings of the tabs are aligned with the openings of the protrusions. Conventional fasteners, such as a bolt and a nut, can then be used to secure the cover 236 to the base 238.

The cover 236 further includes a raised shelf 256 having a pair of apertures 258. The apertures can allow the filter housing assembly 230 to be mounted to a bottom wall of a dirt container. Extending from a bottom surface of the shelf to the edges 246 of the cover 236 are a plurality of reinforcing members or gussets 260, 262. This provides additional stability against vertical deflecting forces and maintains the generally perpendicular relationship between the shelf 256 and the dirt container.

Figure 8:
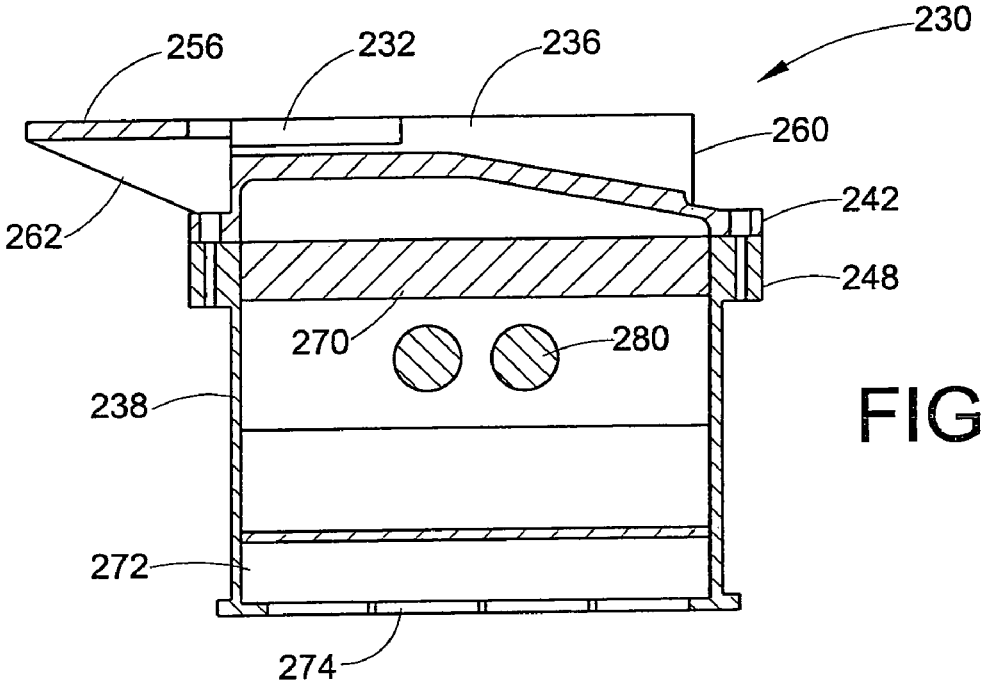
FIG. 8 is a cross-sectional view of the filter housing assembly taken generally along the lines of A-A of FIG. 6.
Figure 9:
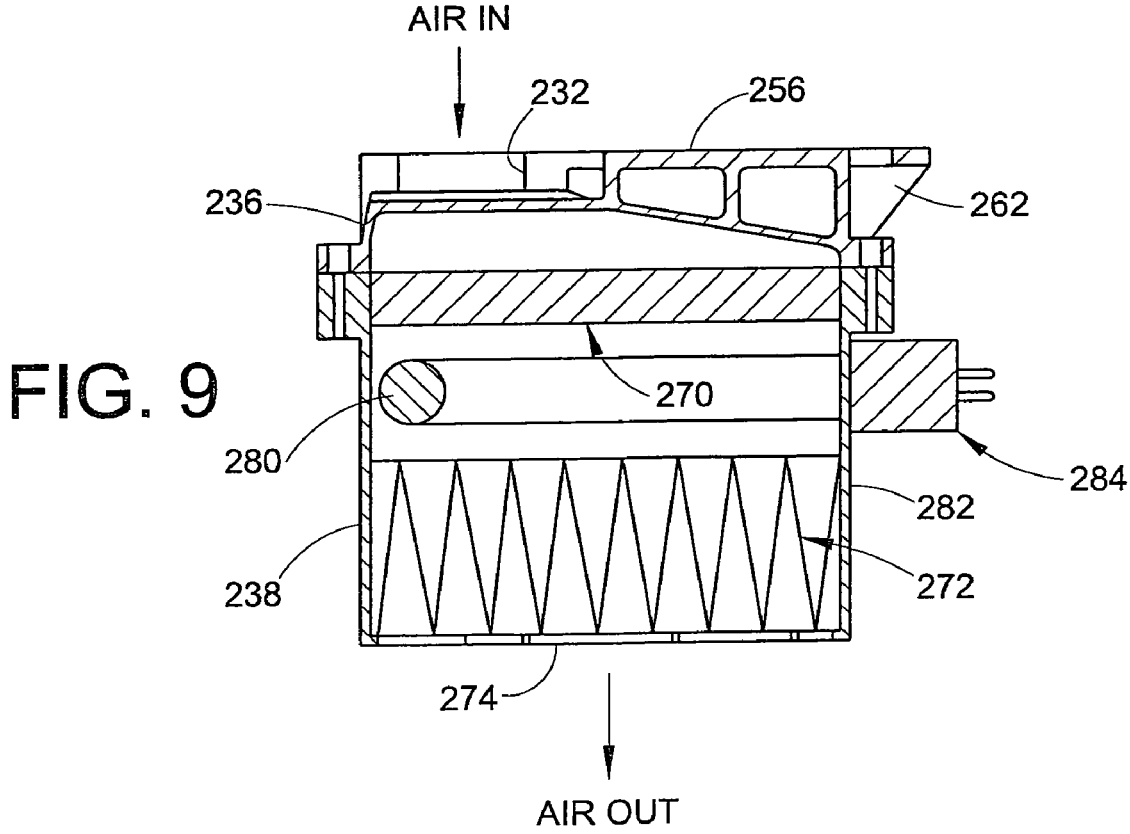
FIG. 9 is a cross-sectional view of the filter housing assembly taken generally along lines of B-B of FIG. 6.

With reference to FIGS. 8 and 9, the filter housing assembly 230 houses a pair of filters 270 and 272 arranged in series to maximize the amount of dust captured by the filter housing assembly 230. The first filter 270 is in fluid communication with suction airstream inlet 232. The first filter can include an open cell flexible foam material having a large dust retaining capacity. The first filter can also be impregnated with particles of carbon, preferably in the form of activated charcoal which has a large surface area for absorbing odors. The second filter 272 is disposed downstream of the first filter. The second filter 272 retains any dust which escapes from the first filter 270 and can comprise a pleated filter material. In one embodiment, the second filter 272 can be an electrostatic or HEPA grade filter, which is capable of trapping very small dust particles. The second filter is in fluid communication with a suction airstream outlet 274 located on a bottom surface of the base 238. The outlet 274, which can be covered by a grill, is in fluid communication with the inlet of an electric motor and fan assembly (not shown) of the vacuum cleaner.

Each filter 270, 272 is suitably secured to the housing member 234 by conventional means. As shown in FIGS. 8 and 9, the first and second filters 270 and 272, respectively, each can have an outer perimeter approximately the same size as an inner perimeter of the housing member 234. This ensures that the airstream flowing through the housing member is filtered by each filter.

With continued reference to FIGS. 8 and 9, the filter housing assembly 230 further includes a germicidal ultraviolet light (UV) source 280 located in the housing member 234 for disinfecting the airstream inside the filter housing. As shown in FIG. 9, the UV light source 280 can be mounted in the housing member 234 by conventional means. The UV light source extends generally normal from a side wall 282 of the base 238 and is disposed between the first filter 270 and the second filter 272 so that the UV light source can shine on both filters to disinfect the filters. An electrical socket 284 is mounted on an outer surface of the side wall 282 for providing a power source from the vacuum cleaner to the UV light source 280. Again, it should be appreciated that the power source that powers the electric motor and fan assembly can also power the UV light source.

Similar to the first embodiment, in addition to disinfecting the airstream inside the filter housing, the UV light source 280 can create ozone from ambient oxygen. Alternatively, the filter housing assembly 230 can include a separate conventional ozonizer for producing ozone in the housing member 234.

Figure 10:
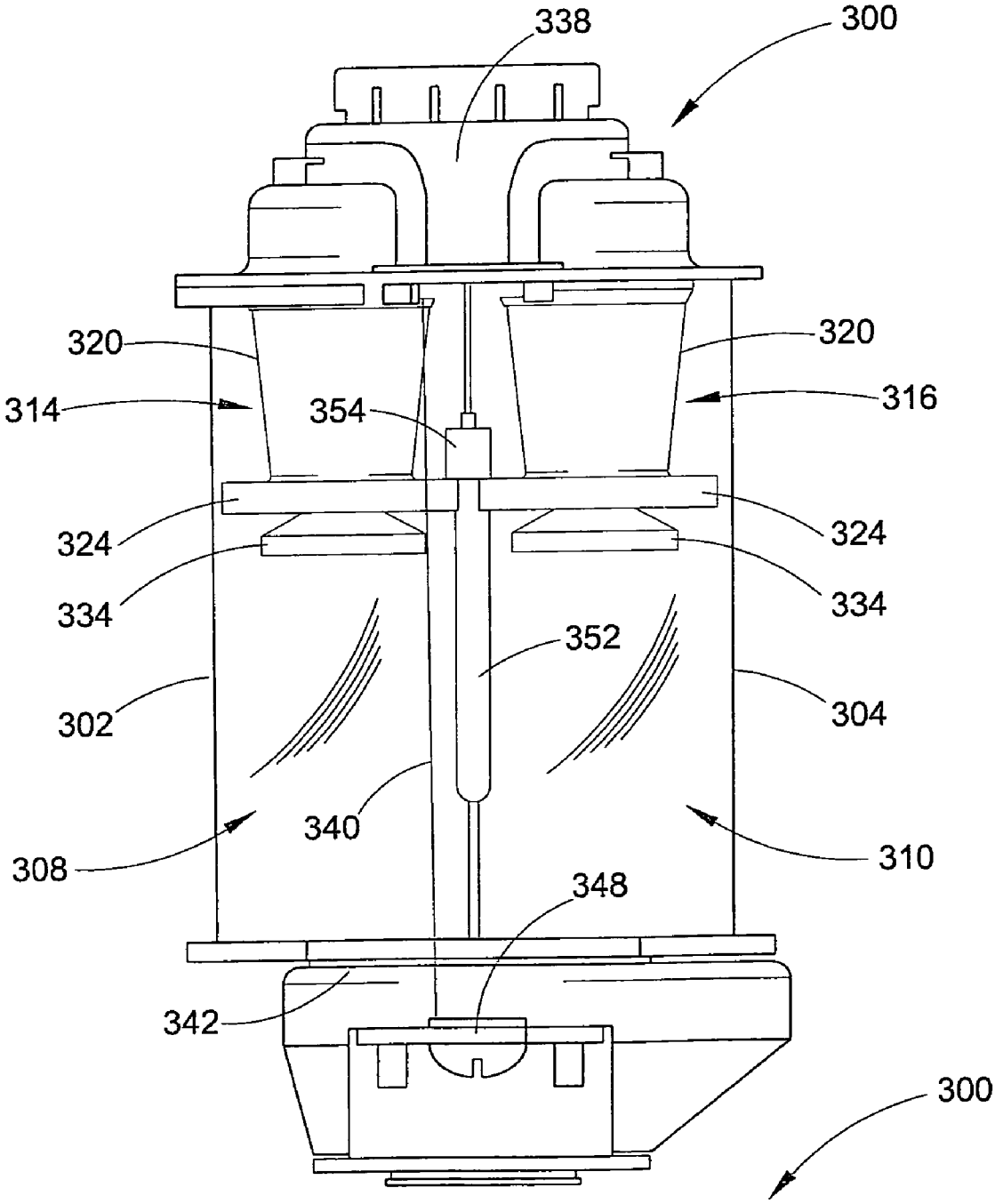
FIG. 10 is a front perspective view of a dirt cup portion of a vacuum cleaner illustrating a means for cleaning an airstream in accordance with a third embodiment of the present invention.

Similar to the aforementioned embodiment, a third embodiment of the present invention is shown in FIG. 10.

In many respects, dirt container 300 is similar to the dirt container 50 described above. The dirt container 300, which can be mounted to a vacuum cleaner upright section via conventional means, includes first and second generally cylindrical sections 302 and 304. Each cylindrical sections includes a longitudinal axis, the longitudinal axis of the first cylindrical section is spaced from the longitudinal axis of the second cylindrical section. The first and second cylindrical sections define a first cyclonic airflow chamber 308 and a second cyclonic airflow chamber 310, respectively. The first and second airflow chambers are each approximately vertically oriented and are arranged in a general parallel relationship.

The first and second cyclonic airflow chambers include respective first and second cyclone assemblies 314 and 316. The first and second cyclone assemblies act simultaneously to remove coarse dust from the airstream. Each cyclone assembly includes a separator cone 320 and a perforated tube (not visible) disposed within the separator cone. The separator cones have a larger diameter end located adjacent a top portion of the dirt container 300 and a smaller diameter end spaced from the top portion. A flange 324 extends radially from the smaller diameter end. The flange is dimensioned to effectively seal off a portion of each cylindrical section 302, 304 from the dirt entrained airstream entering into the first and second cyclonic airflow chambers 308, 310, respectively.

Each perforated tube extends longitudinally in its respective cyclonic airflow chamber 308 and 310. Each perforated tube includes a plurality of small holes disposed in a side wall of the tube for removing threads and fibers from the airstream. Each perforated tube further includes an upper end in fluid communication with an inlet section (not visible) of an air manifold 330 and a closed lower end. The closed lower end of each tube includes an outwardly flared section 334 for retarding an upward flow of dust that has fallen below the lower end of the perforated tube.

The air manifold 330, which is similar to the air manifold 52 described above, is disposed at a top portion of the dirt container 300. The air manifold directs dirty air to each of the first and second cyclonic flow chambers 308, 310 and directs a flow of cleaned air from each of the first and second cyclonic flow chambers to an electric motor and fan assembly of the vacuum cleaner. The air manifold 330 includes the inlet section through which dirty air passes and an outlet section 338. The outlet section collects a flow of cleaned air from both of the airflow chambers and merges the flow of cleaned air into the single cleaned air outlet passage 340.

The outlet passage 340 has a longitudinal axis which is oriented approximately parallel to the longitudinal axes of the first and second cyclonic airflow chambers 308,310. An inlet end of the outlet passage 340 is secured to a lower portion of the air manifold 330. An outlet end of the outlet passage 340 extends through an opening located in a bottom wall 342 of the dirt container 300 and a corresponding inlet 348 located in a filter housing assembly 350. It should be appreciated that the filter housing assembly 350 can be a filter housing assembly similar to the filter housing assembly 132 and filter housing assembly 230 described above.

The dirt container 300 further includes a germicidal ultraviolet (UV) light source 352 mounted between the first cyclonic flow chamber 308 and the second cyclonic flow chamber 310. More particularly, the flanges 324 include a recess (not visible) which define an opening between the airflow chambers dimensioned to receive the UV light source. As the UV light source 352 is being positioned in the opening, an electrical socket 354 attached to an end of the UV light source for providing a power source to the UV light source will abut a top surface of the flanges 324. Thus, once secured, the UV light source is oriented approximately parallel to the longitudinal axes of the first and second cyclonic airflow chambers 308, 310.

In operation, as the dirt entrained air enters the airflow chambers 308, 310, the air and the dirt cyclonically rotate along an inner wall of the separator cone 320. The dirt and debris is removed from the air flow and collects at a bottom portion of the chambers. The UV light source 352 shines on the bottom portion of the chambers to destroy any bacteria and/or viruses trapped in the removed dirt and debris. In addition to disinfecting the airstream inside the airflow chambers 308, 310, the UV light source 352 can act as an ozonizer by producing abundant amounts of ozone from ambient oxygen in the airflow chambers to destroy any remaining airborne bacterial and viral contaminants contained in the airflow chambers. The cleaned air is then discharged out through the holes of the perforated tube and the outlet section 338 of the air manifold 330 and into the single cleaned air outlet passage 340.

Figure 11:
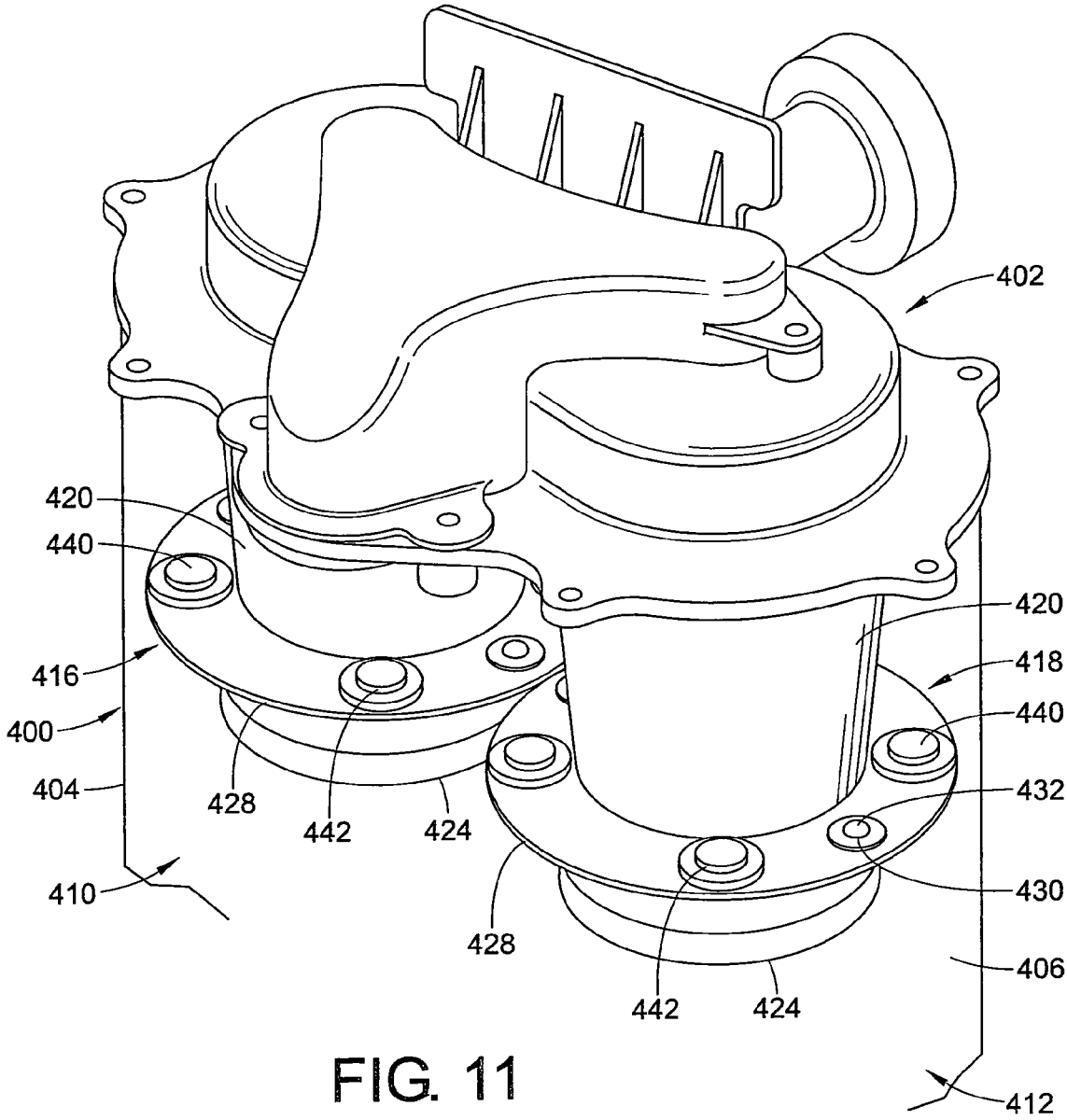
FIG. 11 is an enlarged front perspective view of a portion of a cyclonic air flow vacuum cleaner in accordance with a fourth embodiment of the present invention.

Similar to the aforementioned embodiments, a fourth embodiment of the present invention is shown in FIG. 11. Again, in many respects, a dirt container 400 (shown schematically) and an air manifold 402 disposed at a top portion of the dirt container are similar to those described above.

The dirt container 400, which can be mounted to a vacuum cleaner (not shown) via conventional means, includes first and second generally cylindrical sections 404 and 406. The first and second cylindrical sections define a first cyclonic airflow chamber 410 and a second cyclonic airflow chamber 412, respectively. The first and second airflow chambers can be each approximately vertically oriented and can be arranged in a general parallel relationship.

The first and second cyclonic airflow chambers include respective first and second cyclone assemblies 416 and 418 which act simultaneously to remove coarse dust from the airstream. Each cyclone assembly includes a separator cone 420 and a perforated tube (not visible) disposed within the separator cone. A closed lower end of each tube includes an outwardly flared section 424 for retarding an upward flow of dust that has fallen below the lower end of the perforated tube.

The separator cones have a larger diameter end located adjacent a top portion of the dirt container 400 and a smaller diameter end spaced from the top portion. A flange 428 extends radially from the smaller diameter end. The flange is dimensioned to effectively seal off a portion of each cylindrical section 404, 406 from the dirt entrained airstream entering into the first and second cyclonic airflow chambers 410, 412, respectively.

Each flange 428 includes at least one aperture 430 for securing at least one germicidal ultraviolet (UV) light source 432. In this embodiment, each flange includes a pair of diametrically opposed apertures for securing two UV light sources. Similar to the previous embodiments, the UV light sources 432 disinfect the airstream inside the airflow chambers 410, 412. The UV light sources can also act as ozonizers by producing ozone from ambient oxygen in the airflow chambers to destroy airborne bacterial and viral contaminants contained in the airflow chambers. Each flange further includes at least one indicator 440, such as a light emitting diode, disposed in both of the first and second airflow chambers 410, 412 for indicating a power status of the UV light sources 432. In this embodiment, four indicators are mounted in four spaced apart openings 442 located on each flange 428. Each UV light source 432 and indicator 440 can be powered by a conventional power source, such as the power source that powers an electric motor and fan assembly.

Figure 12:
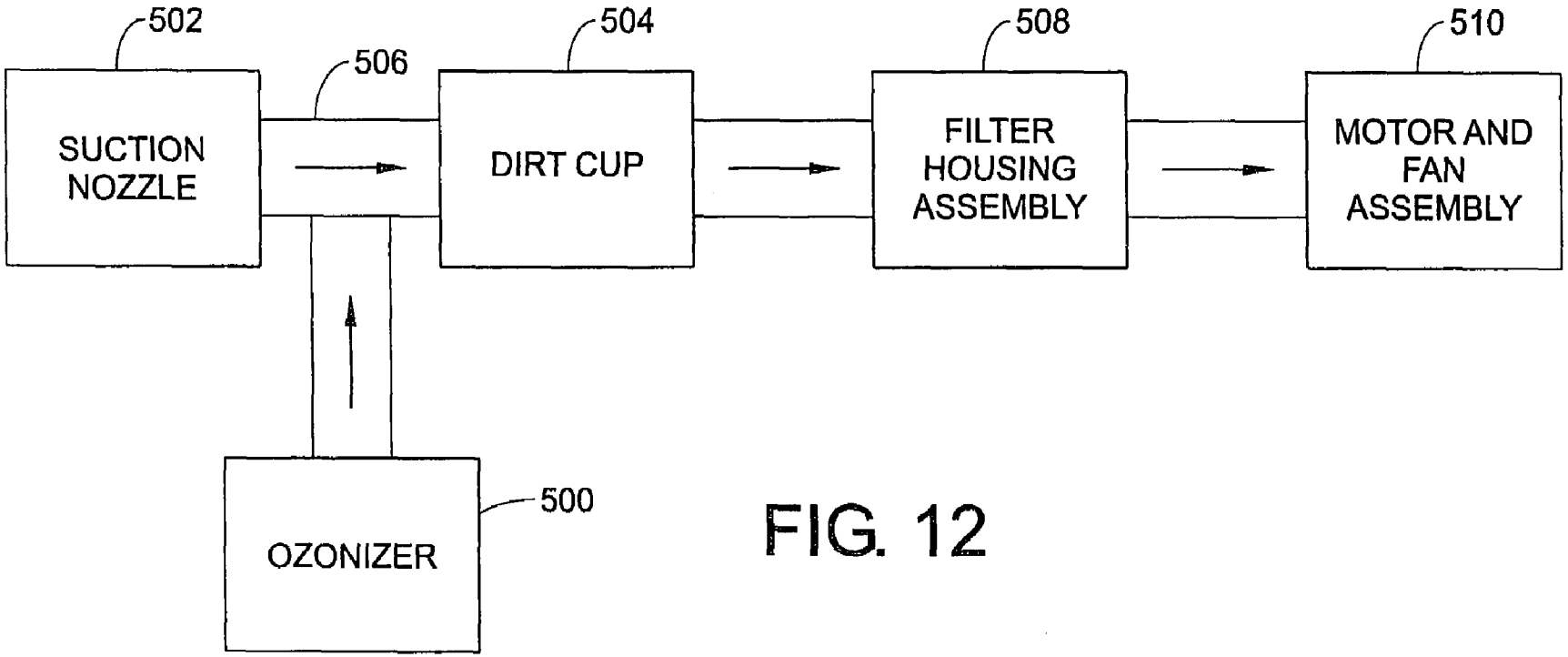
FIG. 12 is a simplified schematic of a means for eradicating bacteria, viruses and fungi in the airflow of a vacuum cleaner in accordance with a fifth embodiment of the present invention.

FIG. 12 schematically illustrates a means for eradicating bacteria, viruses and fungi in the airflow of a vacuum cleaner in accordance with a fifth embodiment of the present invention.

As shown in FIG. 12, a separate conventional ozonizer 500 for producing ozone is located downstream of a suction nozzle 502 and upstream of a dirt cup 504. The dirt cup can be similar to the dirt containers described above. Ozonizers of the general type under consideration are shown and described, for example, in U.S. Pat. Nos. 5,484,472; 5,667,564; 5,814,135; 5,911,957; 6,042,637; and 6,565,805. The disclosures of these patents are incorporated herein by reference. As shown therein, these conventional ozonizers generally generate ozone by passing an oxygen-containing gas between two electrodes, separated by a dielectric material. The oxygen is converted to ozone as it travels through the electrical corona.

The ozonizer 500 directs ozone into a suction flow path 506 which is in fluid communication with an inlet of the dirt cup 504. The ozone is circulated with the dirt entrained airstream entering into the dirt cup from the suction nozzle 502 of the vacuum cleaner. As such, the ozone will effectively kill bacteria, viruses and fungi contained in the airstream. Ozone will also kill many of the bugs trapped in the removed dirt and debris contained in the dirt cup 504. The cleaned air flows out of the dirt cup and is directed to a filter housing assembly 508.

Similar to the previous embodiments, the filter housing assembly 508 can house at least one filter to retain any dust escaping from the dirt cup 504. The at least one filter can comprise a pleated filter material and can be an electrostatic or HEPA grade filter. The filter housing assembly 508 can include a germicidal UV source for further disinfecting the airstream inside the filter housing assembly. An outlet of the filter housing assembly 508 is in fluid communication with an inlet of an electric motor and fan assembly 510.

The ozonizer 500 and the UV light source can be powered by a conventional power source, such as a battery or the power source that powers the electric motor and fan assembly 510.

Figure 13:
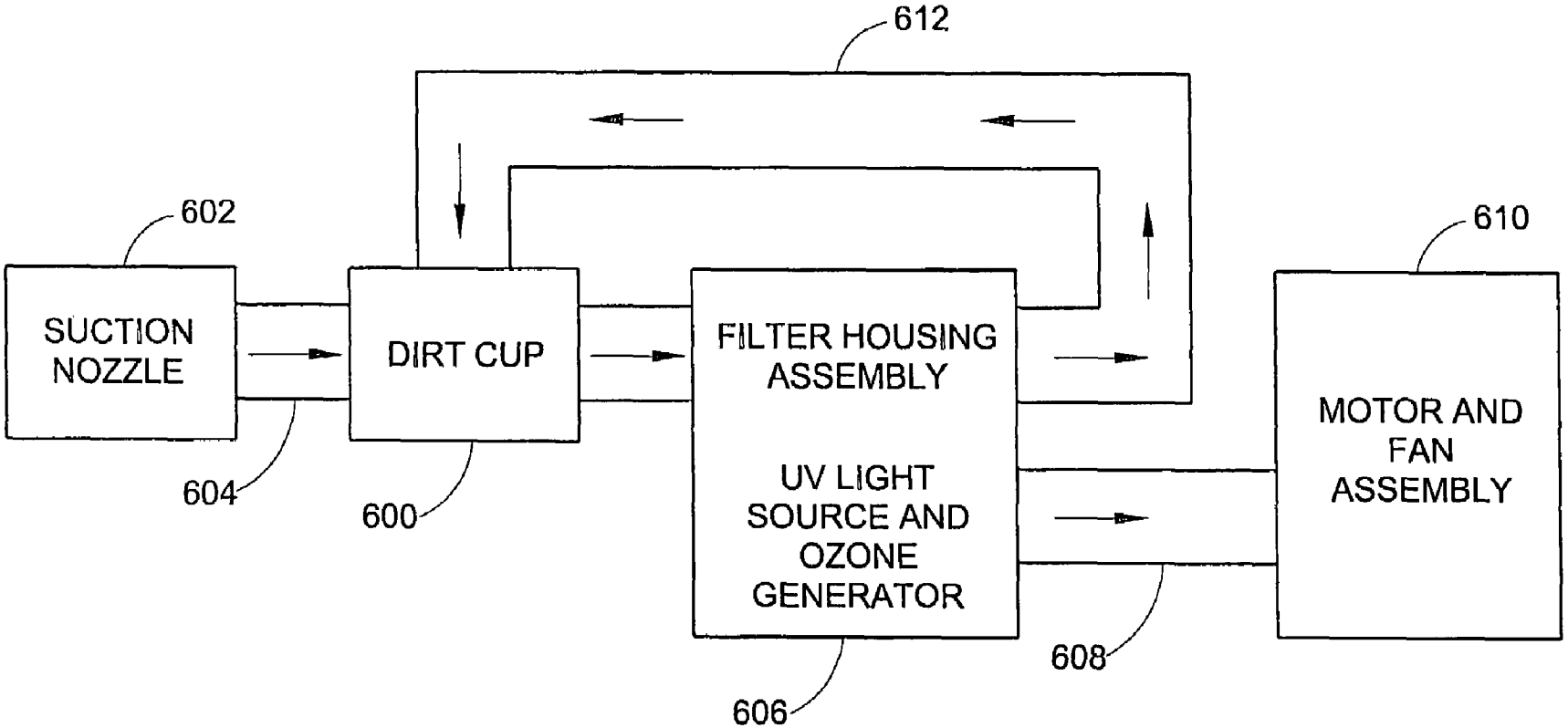
FIG. 13 is a simplified schematic of a means for eradicating bacteria, viruses and fungi in the airflow of a vacuum cleaner in accordance with a sixth embodiment of the present invention.

A sixth embodiment of a means for eradicating bacteria, viruses and fungi in the airflow of a vacuum cleaner is schematically illustrated in FIG. 13.

As shown in FIG. 13, dirt entrained air enters a dirt cup 600 from a suction nozzle 602 of the vacuum cleaner via a suction flow path 604, the dirt cup again can be similar to the dirt containers described above. The dirt cup separates dirt and debris from the airstream and circulates the cleaned air to a filter housing assembly 606. Similar to the previous embodiments, the filter housing assembly 606 can house at least one filter to retain any dust escaping from the dirt cup 600. The filter housing assembly 606 includes a germicidal UV source (not shown) which disinfects the airstream inside the filter housing assembly. In addition to disinfecting the airstream inside the filter housing assembly, and as set forth above, the UV light source creates ozone from ambient oxygen. The ozone will eliminate any bacteria, fungi and/or viruses remaining in the airstream or trapped in or on the filter. The filter housing assembly 606 is in fluid communication with an air path 608 which directs a portion of the sanitized air to an inlet of an electric motor and fan assembly 610. The filter housing assembly also redirects a portion of the airstream back to the dirt cup 604 through a separate air path 612. The redirected airstream contains sufficient amounts of ozone which can kill many of the bugs trapped in the removed dirt and debris contained in the dirt cup. Generally, ozone has a half-life of only about twenty-two minutes at ambient temperature. Thus, the ozone molecules will eventually turn into common oxygen molecules.

Figure 14:
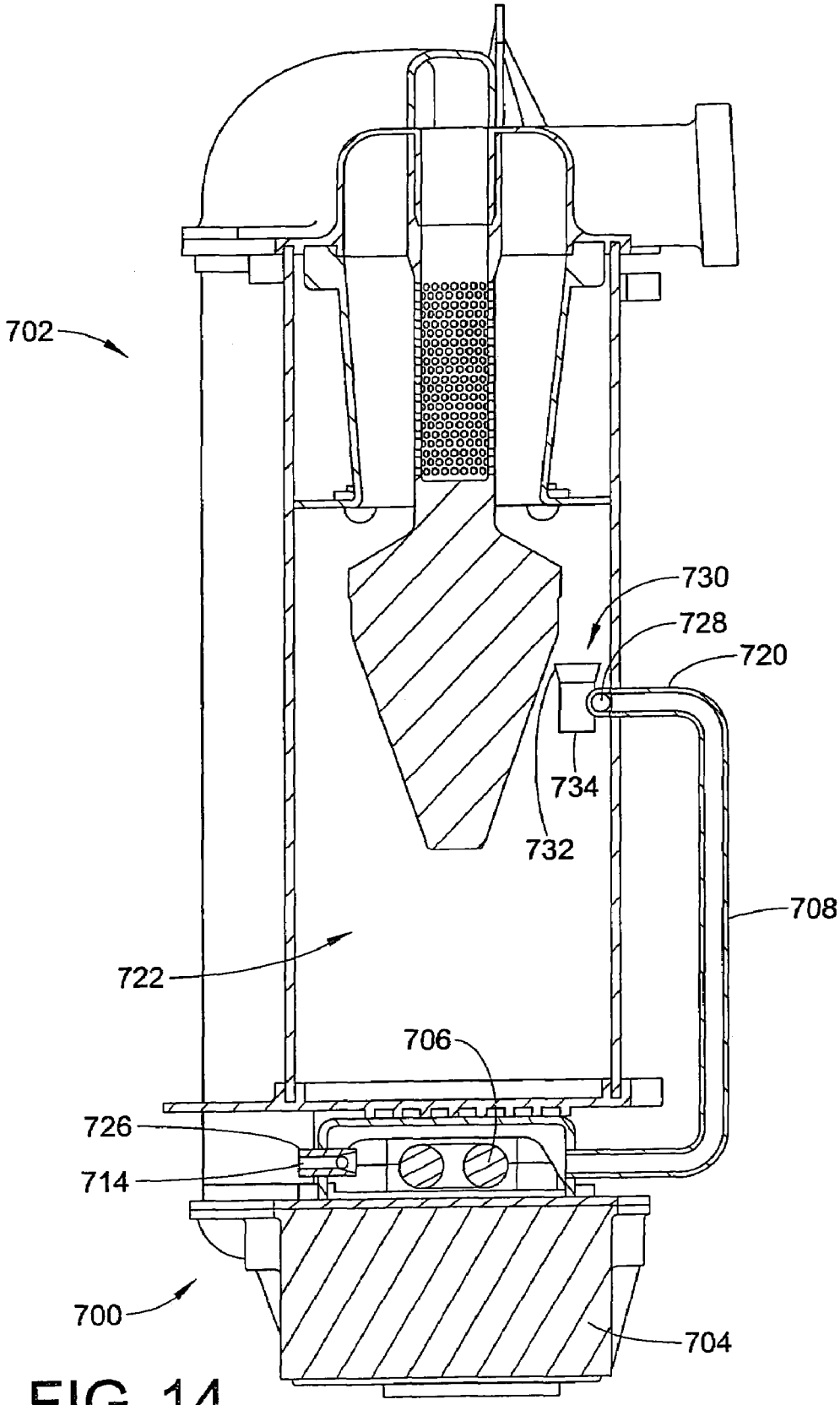
FIG. 14 is a right side elevational view in cross section, and partially broken away, of a means for cleaning an airstream in accordance with a seventh embodiment of the present invention.

A seventh embodiment of a means for cleaning an airstream, specifically for redirecting airstream containing ozone from a filter housing assembly 700 to a dirt cup 702, is illustrated in FIG. 14. The filter housing assembly 700 and the dirt cup 702 are similar to the dirt container 50 and the filter housing assembly 132 described above. Accordingly, no further discussion relating to the structure of the dirt cup and filter housing will be provided.

The dirt cup 702 separates dirt and debris from the airstream and circulates the cleaned air to the filter housing assembly. The filter housing assembly 700 can house at least one filter 704 to retain any dust escaping from the dirt cup and includes an isolated germicidal UV source 706 which shines on a surface of the filter for disinfecting the filter and the airstream flowing through the filter housing assembly. In addition to disinfecting the airstream, and as set forth above, the UV light source creates ozone from ambient oxygen. As shown in FIG. 14, the ozone created in the filter housing assembly can be redirected back to the dirt cup 702 through a separate conduit or hose 708.

The hose includes a first end 714 in fluid communication with an upper section 718 of the filter housing assembly which contains the UV source 706. A second end 720 of the hose 708 is in fluid communication with a cyclonic airflow chamber 722 partially defined in the dirt cup 702. Each hose end 714 and 720 includes a valve 726 and 728, respectively. In this embodiment, the valves are check valves; although, it should be appreciated that other valves can be used with departing from the scope-of the present invention. Mounted to the second hose end 720 and located within the cyclonic airflow chamber 722 is a cup 730 including an inlet section 732 having a first diameter and an outlet section 734 having a second, smaller, diameter. This cup arrangement increases the velocity of the airstream through the cup which creates a higher speed lower pressure area in the dust cup 702 to create a venturi effect. The venturi effect also creates an increased vacuum in the cup 730 which opens each check valve 726, 728 in the hose 708. Because the upper section 718 of the filter housing assembly 700 is isolated from the main air flow from the dirt cup 702, the increased vacuum in the cup suctions ambient air from the upper section 718 to the cyclonic airflow chamber 722 of the dirt cup 702. This redirected ambient air contains sufficient amounts of ozone which can kill many of the bugs trapped in the removed dirt and debris contained in the dirt cup. It should also be appreciated that the hose 708 can include a conventional disconnect (not shown) so that the dirt cup can be easily removed from the vacuum cleaner without interference from the hose.

Figure 15:
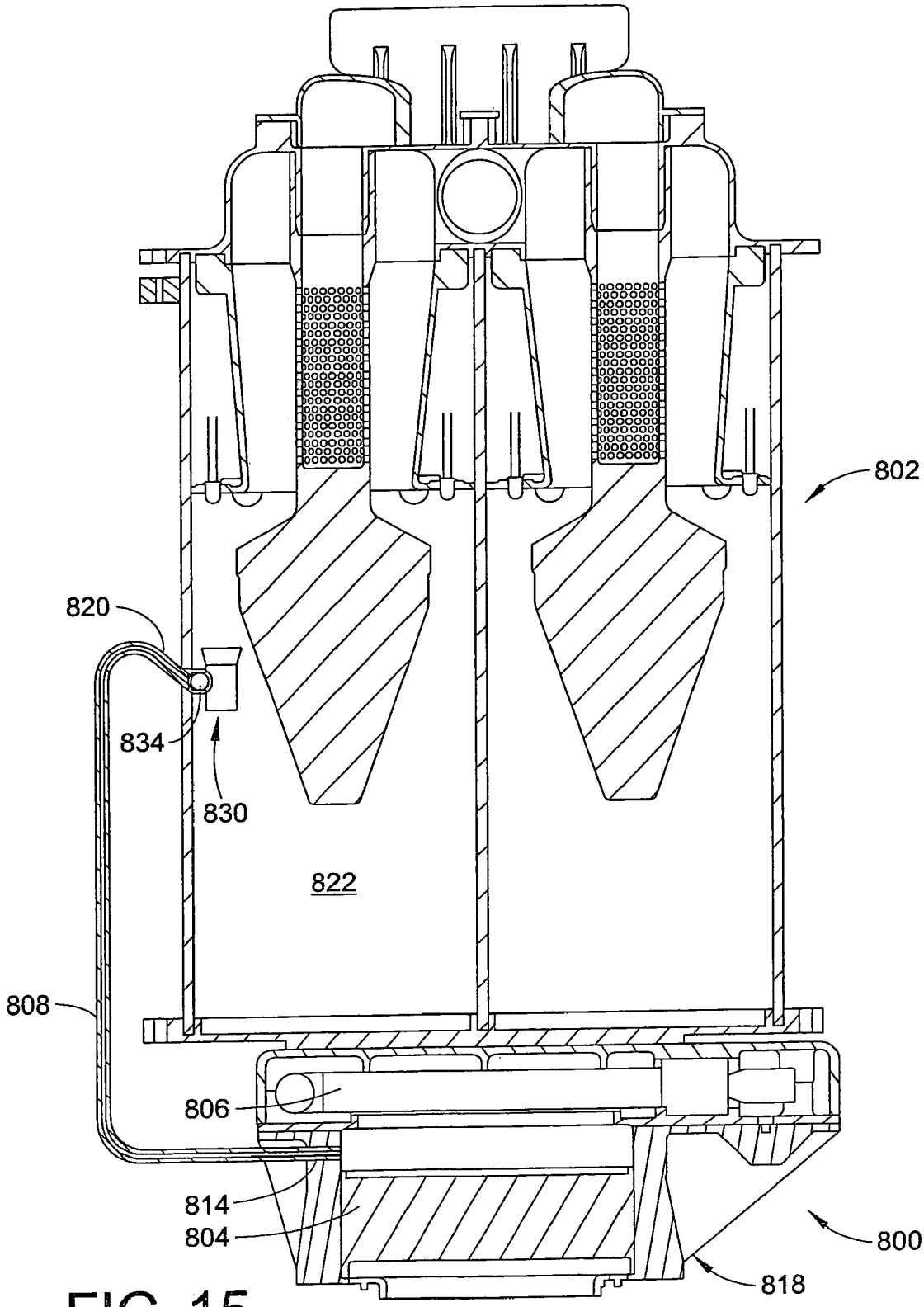
FIG. 15 is a rear elevational view in cross section, and partially broken away, of a means for cleaning an airstream in accordance with an eighth embodiment of the present invention.

Similar to the seventh embodiment, an eighth embodiment of a means for redirecting airstream containing ozone from a filter housing assembly 800 to a dirt cup 802 is illustrated in FIG. 15.

The dirt cup 802 separates dirt and debris from the airstream and circulates the cleaned air to the filter housing assembly 800 which can include at least one filter 804 to retain any dust escaping from the dirt cup and a germicidal UV source 806. The UV source disinfects the filter and the airstream flowing through the filter housing assembly and can create ozone from ambient oxygen. As shown in FIG. 15, the ozone created in the filter housing assembly can be redirected back to the dirt cup 802 through a separate conduit or hose 808.

The hose includes a first end 814 in fluid communication with a lower section 818 of the filter housing assembly which contains the at least one filter 804. A second end 820 of the hose is in fluid communication with a cyclonic airflow chamber 822 partially defined in the dirt cup 802. Mounted to the second hose end 820 and located within the cyclonic airflow chamber 822 is a cup 830 having features similar to that of cup 730. Air flowing through the cup has an increased velocity compared to the air flowing through the cyclonic airflow chamber 822. As such, a venturi effect is created which increases vacuum in the cup 830. This, in turn, opens a valve 834 in the second hose end 820 and a valve (not shown) in the first hose end 814. This increased vacuum suctions a portion of the airstream flowing through the at least one filter 804 from the dirt cup back to the cyclonic airflow chamber 822. This redirected airstream contains sufficient amounts of ozone which can kill many of the bugs trapped in the removed dirt and debris contained in the dirt cup. Again, it should also be appreciated that the hose 808 can include a conventional disconnect (not shown) so that the dirt cup can be easily removed from the vacuum cleaner without interference from the hose.

The disclosure has been described with reference to the preferred embodiments. Obviously, modifications and alterations will occur to others upon reading and understanding the preceding detailed description. It is intended that the disclosure be construed as including all such modifications and alterations insofar as they come within the scope of the appended claims or the equivalents thereof.

What is claimed is:

1. A filter housing assembly for a vacuum cleaner including a suction airstream inlet and a suction airstream outlet, said filter housing assembly comprising:

a housing member mounted to the vacuum cleaner;

a first filter mounted in said housing member;

an ultraviolet light source located in said housing member for disinfecting an interior of said filter housing; and an electrical circuit for providing a power source to said ultraviolet light source, wherein said first filter is in fluid communication with said suction airstream inlet and further including a second filter disposed downstream of said first filter, said second filter being in fluid communication with said suction airstream outlet.

2. The assembly of claim 1 wherein said first filter includes an open cell flexible foam material.

3. The assembly of claim 1 wherein said second filter includes a High-Efficiency Particulate Arresting (HEPA) filter material.

4. The assembly of claim 1 wherein said ultraviolet light source is disposed between said first filter and said second filter.

5. The assembly of claim 1 wherein said second filter comprises a pleated filter material.

6. The assembly of claim 1 wherein the electrical circuit includes an electrical socket mounted on an outer surface of said housing member.

7. The assembly of claim 1 further comprising an ozonizer.

8. A vacuum cleaner including:

a nozzle base including a main suction opening;

a housing pivotally mounted on said nozzle base;

an airstream suction source mounted to one of said housing and said nozzle base for selectively establishing and maintaining a suction airstream flowing from said nozzle main suction opening to an exhaust outlet of said suction source;

a filter housing assembly mounted to one of said nozzle base and said housing, said filter housing assembly comprising:

a filter mounted in said filter housing assembly; and an ultraviolet light source disposed in said filter housing assembly and shining on said filter for disinfecting same; and a dirt cup selectively mounted to said housing, said dirt cup being located upstream of said filter housing assembly.

9. The vacuum cleaner of claim 8 wherein said filter housing assembly further includes an electrical socket for providing a power source to said ultraviolet light source.

10. The vacuum cleaner of claim 8 wherein said filter housing assembly further includes a cover releasably secured to a base, said cover including a suction airstream inlet in fluid communication with said nozzle main suction opening, said base including a suction airstream outlet in fluid communication with an inlet of said suction source.

11. The vacuum cleaner of claim 8 further including a cyclonic airflow chamber.

12. The vacuum cleaner of claim 11 further including an ozone source for disinfecting the air inside said cyclonic airflow chamber.

13. The vacuum cleaner of claim 8 further including an indicator for indicating a power status of said ultraviolet light source.

14. A vacuum cleaner including:

a housing in fluid communication with a main suction opening;

an airstream suction source mounted to said housing for selectively establishing and maintaining a suction airstream flowing from said main suction opening to an exhaust outlet of said suction source; and a filter housing assembly mounted to said housing, said filter housing assembly comprising:

a first filter, a second filter, and an ultraviolet light source shining on said first and second filters for disinfecting same.

15. The vacuum cleaner of claim 14 wherein said filter housing assembly further includes an electrical socket for providing a power source to said ultraviolet light source.

16. The vacuum cleaner of claim 14 wherein said filter housing assembly further includes a base and a cover releasably secured to the base, said cover including a suction airstream inlet in fluid communication with said main suction opening, said base including a suction airstream outlet in fluid communication with an inlet of said airstream suction source.

17. The vacuum cleaner of claim 14 further including a dirt cup selectively mounted to said housing, said dirt cup being located upstream of said filter housing assembly.

18. The vacuum cleaner of claim 17 wherein said dirt cup includes a cyclonic airflow chamber.

19. A vacuum cleaner comprising:

a dirt cup;

a cyclonic flow chamber located upstream from said dirt cup;

a filter housing assembly disposed downstream from said cyclonic flow chamber for accommodating at least one filter for filtering dirt from the airstream; and an ultraviolet light source secured to at least one of said dirt cup and said filter housing assembly, wherein said ultraviolet light source shines on dirt accumulated in said dirt cup for disinfecting same.

20. The vacuum cleaner of claim 19 wherein said ultraviolet light source is mounted to said cyclonic flow chamber.

21. The vacuum cleaner of claim 19 wherein said ultraviolet light source is disposed inside said filter housing assembly.

22. The vacuum cleaner of claim 19 further comprising an ozonizer communicating with at least one of said dirt cup and said filter housing assembly.

23. The vacuum cleaner of claim 19 wherein said ultraviolet light source generates a concentration of ozone.

24. The vacuum cleaner of claim 19 wherein said filter housing assembly is in fluid communication with said dirt cup for disinfecting dirt accumulated in said dirt cup.

* * * * *